US008839966B2

(12) United States Patent
Walker et al.

(10) Patent No.: US 8,839,966 B2
(45) Date of Patent: Sep. 23, 2014

(54) FOLDING JIB MAIN STRUT AND TRANSPORTABLE REEVED STRUT CAPS

(75) Inventors: Robert J. Walker, Manitowoc, WI (US); Michael J. Wanek, Two Rivers, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 710 days.

(21) Appl. No.: 12/730,421

(22) Filed: Mar. 24, 2010

(65) Prior Publication Data

US 2010/0243595 A1 Sep. 30, 2010

Related U.S. Application Data

(60) Provisional application No. 61/165,403, filed on Mar. 31, 2009.

(51) Int. Cl.

| | |
|---|---|
| ***B66C 23/82*** | (2006.01) |
| ***B66C 23/70*** | (2006.01) |
| ***B66C 23/26*** | (2006.01) |
| ***B66C 23/36*** | (2006.01) |

(52) U.S. Cl.

CPC ..... *B66C 23/365* (2013.01); *B66C 23/26* (2013.01); *B66C 23/82* (2013.01)

USPC ..... 212/177; 212/175; 212/294; 212/299

(58) Field of Classification Search

CPC ..... B66C 23/34; B66C 23/32; B66C 23/342; B66C 23/344; B66C 23/346; B66C 23/348; B66C 23/365; B66C 23/26; B66C 23/82; B66C 23/66; B66C 23/823; B66C 23/825; B66C 23/826; B66C 23/828

USPC ..... 212/175–177, 270–271, 294–300

See application file for complete search history.

(56) References Cited

U.S. PATENT DOCUMENTS 2,975,910 A * 3/1961 Conrad ..... 212/300
3,101,816 A * 8/1963 Fox ..... 212/295

(Continued)

FOREIGN PATENT DOCUMENTS

DE 196 42 066 A1 4/1998
EP 1 426 321 A1 6/2004

(Continued)

OTHER PUBLICATIONS

Liebherr LR 1600/2 Rigging Winch—photograph of crane with rigging winch. Available before filing of U.S. Appl. No. 61/165,403, filed Mar. 31, 2009.

(Continued)

*Primary Examiner* — Sang Kim
*Assistant Examiner* — Nathaniel Adams
(74) *Attorney, Agent, or Firm* — Brinks Gilson & Lione; Craig Buschmann

(57) ABSTRACT

A method of assembling a mobile lift crane that includes, during operation, i) a rotating bed having attached thereto a luffing jib hoist drum and line, and a rigging winch drum and line, ii) a boom pivotally mounted on the rotating bed, iii) a luffing jib pivotally mounted to the end of the boom, iv) a first strut also pivotally connected to the end of the boom, and v) a second strut connected to the boom below the connection point of the first strut, the method including: a) pivotally connecting the first strut to the end of the boom; b) pivotally connecting a first section of the second strut near the top of the boom; c) connecting the rigging winch line to the top of the first section; d) pivotally attaching a second section of the second strut to the first section such that the second section lies folded onto the first section, forming a folded second strut; and e) lifting the second section while retracting the rigging winch line to thereby bring the first and second sections into alignment with each other.

16 Claims, 8 Drawing Sheets

(56) References Cited

U.S. PATENT DOCUMENTS

| | | | | |
|---|---|---|---|---|
| 3,338,428 | A * | 8/1967 | Weber | 212/295 |
| 3,680,840 | A * | 8/1972 | Pech | 212/232 |
| 4,159,776 | A | 7/1979 | Holter | |
| 4,383,616 | A | 5/1983 | Sterner et al. | |
| 7,341,158 | B2 | 3/2008 | Toudou et al. | |
| 2004/0124167 | A1 * | 7/2004 | Willim | 212/300 |
| 2008/0116161 | A1 * | 5/2008 | Kurotsu et al. | 212/262 |
| 2008/0264887 | A1 * | 10/2008 | Porubcansky | 212/198 |

FOREIGN PATENT DOCUMENTS

| | | | |
|---|---|---|---|
| EP | 1 927 571 | A2 | 6/2008 |
| FR | 2 551 041 | A1 | 3/1985 |
| JP | 57 184884 | U | 11/1982 |
| JP | 60 072483 | U | 5/1985 |
| JP | U1986-127189 | | 8/1986 |
| JP | U1990-083891 | | 6/1990 |
| JP | H04 86694 | U | 7/1992 |
| JP | 6 115881 | A | 4/1994 |
| JP | 8 295489 | A | 11/1996 |

OTHER PUBLICATIONS

Partial European Search Report for corresponding European Patent Application No. 10250626.8, dated Oct. 27, 2010 (7 pages).

Partial European Search Report for EP Application No. 12161916.7, 12 pages, dated Nov. 22, 2012.

Reference Drawings of the Equilizer Arrangment from Model 18000, A04342, sold prior to Mar. 31, 2008, 4 pages.

Reference Drawings of the Equilizer Arrangment from Model 18000, A05378, sold prior to Mar. 31, 2008, 4 pages.

Reference Drawings of the Equilizer Arrangment from Model 16000, A14503, sold prior to Mar. 31, 2008, 4 pages.

Office Action for corresponding CN Application No. 201010176668.3, 8 pages, dated Oct. 30, 2013.

First JP Office Action of May 13, 2014 with English language translation of office action for related JP Patent Application No. 2010-076746.

* cited by examiner 31
114
119
122
118
27, 29

116
116
31
31
114
114
115
115
118
118
119
27, 29

116
31
31
114
114
115
115
118
118
19
100

FOLDING JIB MAIN STRUT AND TRANSPORTABLE REEVED STRUT CAPS

REFERENCE TO EARLIER FILED APPLICATION

The present application claims the benefit of the filing date under 35 U.S.C. §119(e) of Provisional U.S. patent application Ser. No. 61/165,403, which is hereby incorporated by reference in its entirety.

BACKGROUND

The present disclosure relates to a mobile lifting crane that uses a rigging winch drum and rigging to help assemble a folded jib main strut when a luffing jib is employed on the crane. Furthermore, the disclosure relates to the disassembly and assembly of the luffing jib struts on a job site in a way that allows the sheaves of strut caps to remain reeved during transport to or from the job site, to prevent re-reeving the strut caps at a new job site.

Mobile lift cranes typically include a carbody having moveable ground engaging members; a rotating bed rotatably connected to the carbody such that the rotating bed can swing with respect to the ground engaging members; a boom pivotally mounted on a front portion of the rotating bed, with a load hoist line extending therefrom, and counterweight to help balance the crane when the crane lifts a load. Additionally, when the crane needs to work on particularly high buildings or structures, or in restricted spaces, a luffing jib pivotally mounted at the top of the boom may be extended out to provide required reach. When the luffing jib is employed, one or more luffing jib struts are connected to the top of the boom or bottom of the luffing jib. These struts support the luffing jib rigging and backstay straps, providing a moment arm about which force can be applied to raise the jib and support a load being lifted by the luffing jib.

Since the crane will be used in various locations, it needs to be designed so that it can be transported from one job site to the next. This usually requires that the crane be dismantled into components that are of a size and weight that they can be transported by truck within highway transportation limits. The ease with which the crane can be dismantled and set up has an impact on the total cost of using the crane. Thus, to the extent that fewer man-hours are needed to set up the crane, there is a direct advantage to the crane owner or renter. When the luffing jib rigging includes multiple parts of line between the struts, each strut cap usually includes multiple sheaves through which the jib hoist line must be reeved whenever the crane is set up, which takes a significant amount of time.

Several methods have been used in the past to assemble the luffing jib with its luffing jib struts. At least one of those methods involves attaching the assembled jib struts to the end of the boom and reeving the caps of the jib struts with a jib hoist line. The reeving process is time consuming. A whip hoist line may then be used to pull the top of the two jib struts (the jib main strut) over center while it is raised with an assist crane to the point that a backstay suspension, connected at the base of the boom, can be pinned to the top of the main strut. The assist crane must travel while it lifts to perform this lifting operation, and assemblers need to work high off the ground in pinning the backstay suspension, which may lengthen the process and puts the assemblers at more risk.

Accordingly, the present disclosure includes solutions to the above drawbacks with previous methods by making the method for assembly of the jib struts more efficient and safer.

For instance, the need to re-reeve the jib strut caps during set up of the crane on the job site is eliminated, the assist crane need not travel when erecting the main strut, and the assembly steps may be executed closer to the ground.

BRIEF DESCRIPTION OF THE DRAWINGS

FIG. 7 displays the pivotal connection of a first strut section, including an assembled main strut butt and first insert, of the main strut to the top of the boom.

FIG. 8 displays the telescopic attachment of a strut stop between the boom and the main strut butt, and the connecting of a rigging winch line to the top of the first insert.

FIG. 9 displays the pivotal connection of a second strut section, including an assembled main strut top and second insert, to the first insert such that the main strut is folded on itself, and displays the attachment of backstay strap sections to the main strut cap.

FIG. 10 displays the lifting of the main strut cap and sections of backstay straps while paying out the reeved jib hoist line.

FIG. 11 displays the lowering of the main strut cap and the pinning of the sections of backstay straps to additional sections of backstay straps connected to the bottom of the boom.

FIGS. 12 through 14 display the connecting of the main strut cap to the strut top of the main strut.

FIG. 15 displays the retracting of the rigging winch line while lifting the main strut top with a raising pendent attached thereto, to close the folded main strut, thus completing assembly of the luffing jib struts.

DETAILED DESCRIPTION OF THE DRAWINGS AND THE PRESENTLY PREFERRED EMBODIMENTS

Figure 1:
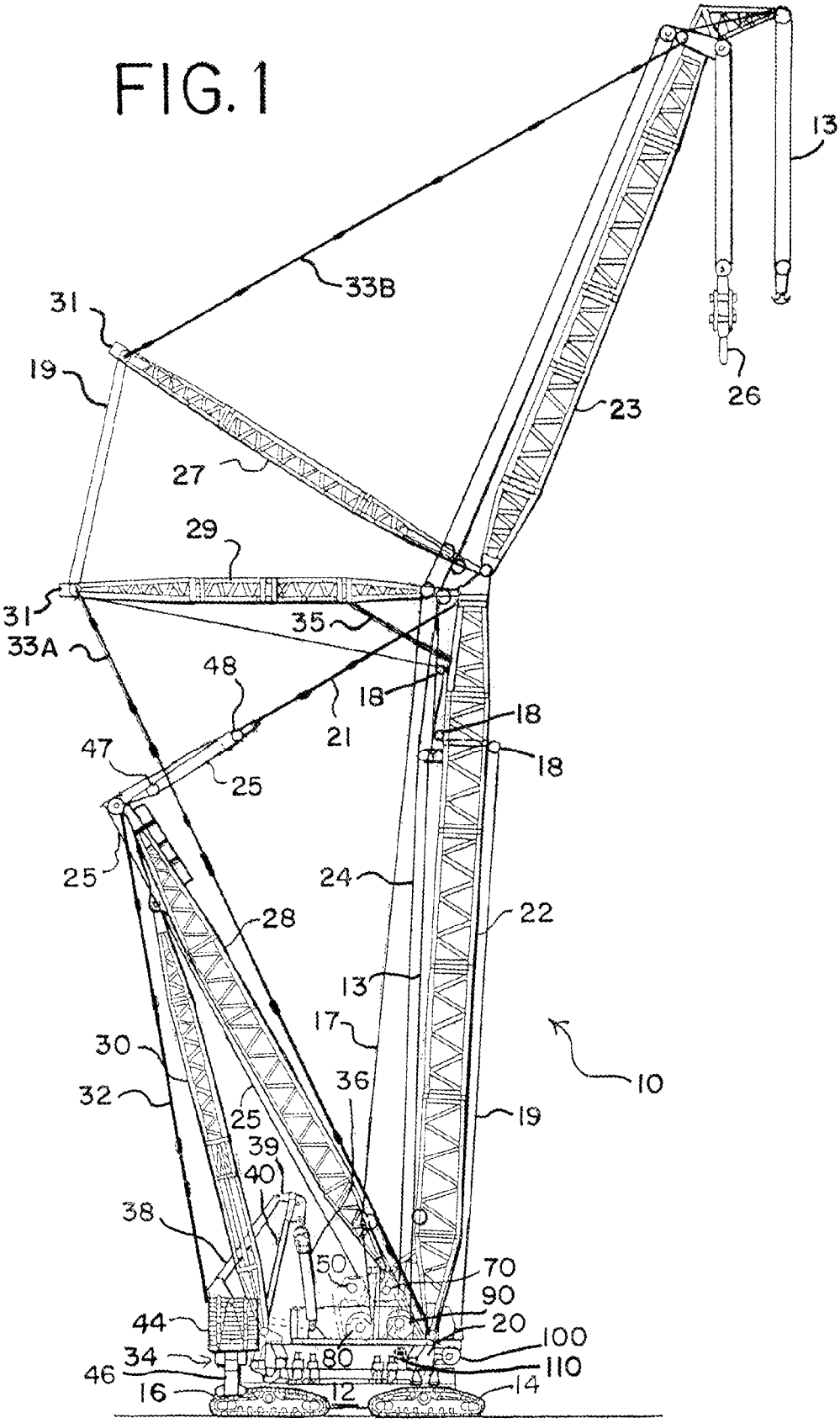
FIG. 1 is a side elevational view of a preferred embodiment of a mobile lift crane utilizing a luffing jib system of the present disclosure.

The present disclosure will now be further described. In the following passages, different aspects of the disclosure are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present embodiments relates to a high capacity mobile lift crane, other aspects of which are disclosed in U.S. Pat. No. 7,546,928 and the following co-pending United States patent applications assigned to the assignee of the present application: "Mobile Lift Crane With Variable Position Counterweight," Ser. No. 12/023,902, filed Jan. 31, 2008; "Mast Raising Structure And Process For High-Capacity Mobile Lift Crane," Ser. No. 11/740,726, filed Apr. 26, 2007; "Connection System For Crane Boom Segments," Ser. No. 12/273,310, filed Nov. 18, 2008; "Drive Tumbler And Track Drive For Mobile Vehicles, Including Lift Cranes," Ser. No. 12/368,143, filed Feb. 9, 2009; "Track Connection System For Mobile Vehicles, Including Lift Cranes," Ser. No. 12/368,125, filed Feb. 9, 2009; "Track Tensioning System For Mobile Vehicles, Including Lift Cranes," Ser. No. 12/368,113, filed Feb. 9, 2009; "Boom Hoist Transportation System And Crane Using Same," Ser. No. 12/561,007, filed Sep. 16, 2009; "Carbody Connection System And Crane Using Same," Ser. No. 12/561,103, filed Sep. 16, 2009; "Trunnion Transportation System And Crane Using Same," Ser. No. 12/561,058, filed Sep. 16, 2009; "Drum Frame System For Cranes," Ser. No. 12/561,094, filed Sep. 16, 2009; "Crane Hook Block," Ser. No. 12/709,678, filed Feb. 22, 2010; Swing Drive System For Cranes," Ser. No. 12/710,960, filed Feb. 23, 2010; Counterweight Block And Assemblies For Cranes", Ser. No. 12/728,156, filed Mar. 5, 2010; "Crane Boom Stop," Ser. No. 61/179,935, filed May 20, 2009; and "Crane Backstay Spreader," Ser. No. 61/179,983, filed May 20, 2009. Each of these applications is hereby incorporated by reference.

Several terms used in the specification and claims have a meaning defined as follows.

The term "strut cap" designates an arrangement of sheaves secured together in supporting structure so as to act in concert in spreading tensional force between multiple parts of the jib hoist line. The strut caps come in pairs. Each of first and second strut caps includes a number of sheaves through which are reeved a wire rope. In the present disclosure, each strut cap of the pair is connected to the top of one of the luffing jib struts during normal crane operation.

The terms "jib main strut," or simply "main strut," designates the luffing jib strut that connects to a lower position on the boom. Through at least one backstay strap connected from the end of the main strut to the bottom of the boom, a fixed angle is maintained between the main strut and the boom. It is the main strut to which the present disclosure refers when discussing erection of a folded luffing jib strut.

The term "jib strut" designates the luffing jib strut that connects higher on (e.g., to the top of) the boom and/or to the bottom of the luffing jib. Through at least one jib support strap connected from the end of the jib strut to the top of the luffing jib, a fixed angle is maintained between the jib strut and the luffing jib.

The term "jib hoist drum" designates a winch used to take up and pay out line that is used to control the angle between the two luffing jib struts (the main and jib struts). The jib hoist drum includes a cylindrical body on which the jib hoist line is wound, as well as the mechanical and hydraulic controls for controlling rotation of the cylindrical body.

The term "jib hoist drum frame" designates the structure that is used to hold the jib hoist drum components together, and to mount them to other crane components, if needed. Also, other components may be mounted to the frame. The term "mounted" includes immobilizing the component to the structure to which it is mounted. However, the term "frame" is meant to designate structure that is reasonably close in size to the drum and used for the above enumerated purposes. Thus structure that is used as another major component of a crane, or that is more than twice as long as the cylindrical part of the drum, or more than twice the diameter of the drum, would not be considered part of a frame of the drum.

The term "strut stop" designates a structure used to prevent the luffing jib from tipping over backwards, and is connected between the jib main strut and the boom. The strut stop works in conjunction with the at least one backstay strap to retain a fixed angle between the jib main strut and the boom, thus preventing the jib strut from rotating too far toward the boom.

The termed "pinned" (and variations thereof, such as "pinning") is meant to designate a connection between components that allows for the transfer of forces between the components, and also allows the connection to be easily disassembled. Most typically, a pinned connection is one that transfers force though shear forces on a pin passing through holes in the two connected structures. In addition to pins, bolts can be used to make a "pinned" connection as that term is used herein.

While the disclosure will have applicability to many types of cranes, it will be described in connection with a mobile lift crane 10, shown in an operational configuration in FIG. 1. The mobile lift crane 10 includes lower works, also referred to as a carbody 12, and moveable ground engaging members in the form of crawlers 14 and 16. There are two front crawlers 14 and two rear crawlers 16, only one each of which can be seen from the side view of FIG. 1. In the crane 10, the ground engaging members could be just one set of crawlers, one crawler on each side. Of course, additional crawlers than those shown can be used, as well as other types of ground engaging members, such as tires.

A rotating bed 20 is rotatably connected to the carbody 12 such that the rotating bed can swing with respect to the ground engaging members. The rotating bed is mounted to the carbody 12 with a slewing ring, such that the rotating bed 20 can swing about an axis with respect to the ground engaging members 14, 16. The rotating bed supports a boom 22 pivotally mounted on a front portion of the rotating bed; a mast 28 mounted at its first end on the rotating bed, with a lower equalizer 47 connected to the mast adjacent the second end of the mast; a backhitch 30 connected between the mast 28 and a rear portion of the rotating bed 20; and a moveable counterweight unit 34. Counterweights used on the counterweight unit 34 may be in the form of multiple stacks of individual counterweight members (or blocks) 44 on a support member.

Boom hoist rigging (described in more detail below) between the top of mast 28 and boom 22 is used to control the boom angle and transfer load so that the counterweight can be used to balance a load lifted by the crane. A load hoist line 24 is trained over a pulley on the boom 22, supporting a hook 26. At the other end, the load hoist line is wound on a first main load hoist drum 70 connected to the rotating bed, described in more detail below. The rotating bed 20 includes other elements commonly found on a mobile lift crane, such as an operator's cab, a hoist drum 50 for the boom hoist rigging, a second main hoist drum 80 and an auxiliary load hoist drum 90 for a whip line, also described in more detail below.

As shown in FIG. 1, the boom 22 includes a luffing jib 23 pivotally mounted to the top of the main boom 22. The crane also includes first and second jib struts 27 and 29, also referred to herein respectively as the jib and main struts, as well as associated luffing jib rigging and a luffing jib hoist drum 100, which in the embodiment depicted is mounted on the front roller carrier of the rotating bed 20. In other embodiments, the luffing jib hoist drum 100 may be attached to the main boom 22, the mast 28, or another structure that is mounted to the rotating bed 20. A luffing jib hoist line 19 runs from the drum 100, through one or more wire guides 18, and up to the rigging that controls the angle between the jib and main struts 27, 29. In one embodiment, the luffing jib hoist line 19 is a wire rope of about 34 mm in thickness. The rigging that controls the angle between the struts includes first and second strut caps 31, each respectively attached to the first and second struts 27, 29. The jib hoist line 19 is reeved through sheaves of the first and second strut caps 31. The strut cap 31 of a strut is detachable in some embodiments. The luffing jib hoist line 19 dead ends on either of the strut caps 31 or on one of the first and second struts 27, 29.

Two backstay straps 33A are connected between the end of the main strut 29, e.g., to the cap thereof, and the bottom of the boom 22. These backstay straps are made of multiple fixed-length sections. Selection of the number of sections and the length of each section allows changing the hypotenuse of the fixed-angle triangle formed between the main strut 29 and the boom 22 to accommodate different boom lengths. By changing the length of the backstay straps 33A, a constant angle may be maintained between the main strut 29 and the boom 22 for each length of the boom for which the crane is designed.

Similarly, sections of jib support straps 33B may be connected between the end of the jib strut 27 and adjacent the top of the luffing jib 23 to maintain a constant angle therebetween. By using the jib support straps 33B as described, paying out or retracting the luffing jib hoist line 19 allows expanding or retracting the angle between only the first and second jib struts 27, 29. Furthermore, a strut stop 35 is connected between the main strut 29 and the boom 22 to provide support to the main strut 29 if no load is on the jib and the forces pulling the main strut up are less than the forces pulling the main strut down.

The backhitch 30 is connected adjacent the top of the mast 28, but down the mast far enough that it does not interfere with other items connected to the mast. The backhitch 30 may comprise a lattice member, as shown in FIG. 1, designed to carry both compression and tension loads. In the crane 10, the mast 28 is held at a fixed angle with respect to the rotating bed 20 during crane operations, such as a pick, move and set operation.

The counterweight unit 34 is moveable with respect to the rest of the rotating bed 20. A tension member 32 connected adjacent the top of the mast 28 supports the counterweight unit in a suspended mode. A counterweight movement structure is connected between the rotating bed and the counterweight unit such that the counterweight unit may be moved to and held at a first position in front of the top of the mast, and moved to and held at a second position rearward of the top of the mast, described more fully in U.S patent application Ser. No. 12/023,902.

At least one linear actuation device 36, such as a hydraulic cylinder, or alternatively a rack and pinion assembly, and at least one arm pivotally connected at a first end to the rotating bed and at a second end to the a linear actuation device 36, are used in the counterweight movement structure of crane 10 to change the position of the counterweight. The arm and linear actuation device 36 are connected between the rotating bed and the counterweight unit such that extension and retraction of the linear actuation device 36 changes the position of the counterweight unit compared to the rotating bed. While FIG. 1 shows the counterweight unit in its most forward position, the linear actuation device 36 can be partially or fully extended, which moves the counterweight unit to mid and aft positions, or any intermediate position, such as when a load is suspended from the hook 26.

In a preferred embodiment of the counterweight movement structure, a pivot frame 40, which may be a solid welded plate structure, is connected between the rotating bed 20 and the second end of the linear actuation device 36. A rear arm 38 is connected between the pivot frame 40 and the counterweight unit 34. The rear arm 38 is also a welded plate structure with an angled portion 39 at the end that connects to the pivot frame 40. This allows the arm 38 to connect directly in line with the pivot frame 40. The backhitch 30 has an A-shape configuration, with spread-apart lower legs, which allows the counterweight movement structure to pass between the legs when needed.

The crane 10 may be equipped with a counterweight support system 46, which may be required to comply with crane regulations in some countries. The counterweight movement structure and counterweight support structure are more fully disclosed in U.S. patent application Ser. No. 12/023,902.

Figure 2:
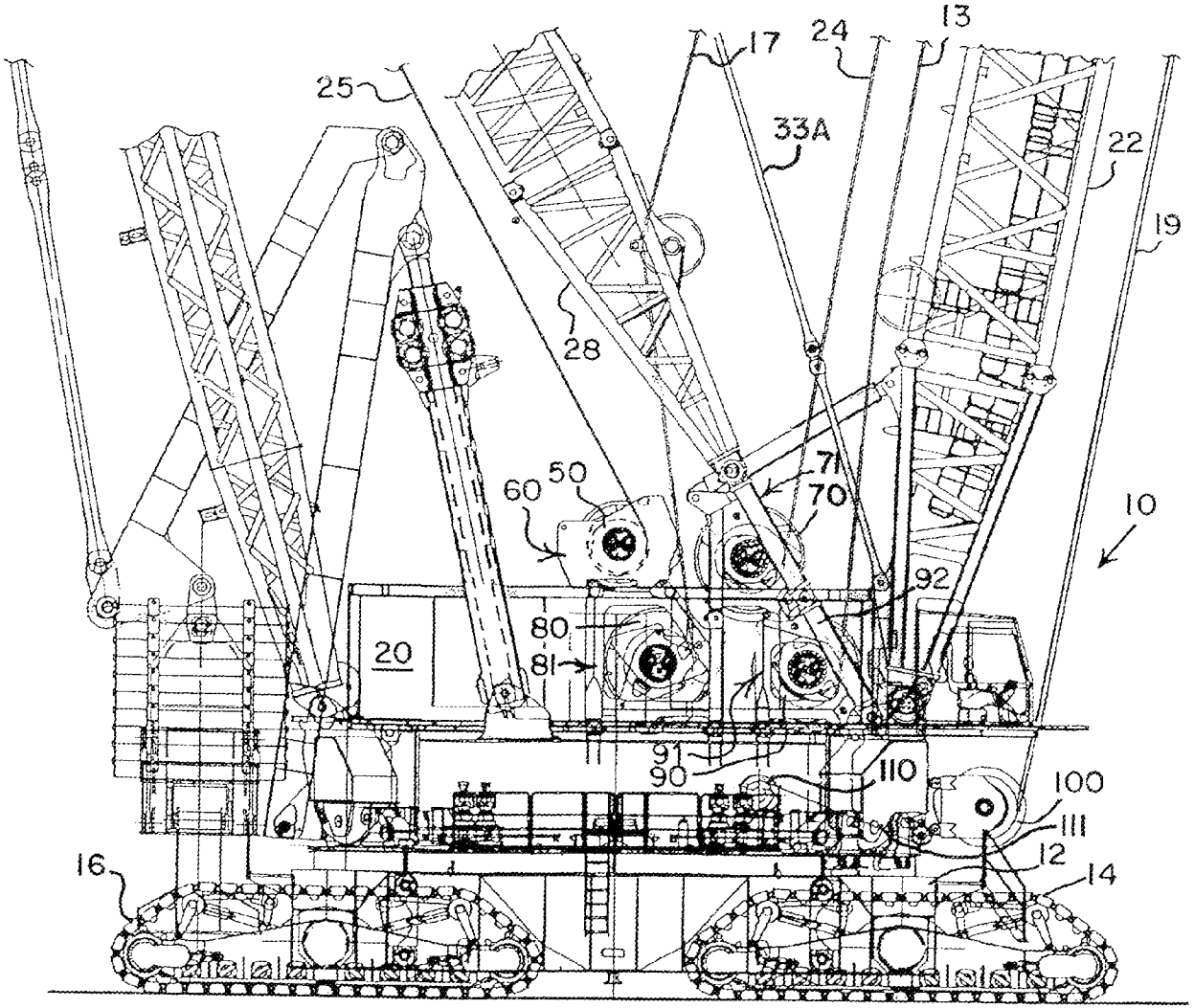
FIG. 2 is an enlarged side elevational view of the crane of FIG. 1 with some of the components removed for sake of clarity.

The boom hoist rigging includes a boom hoist line in the form of wire rope 25 wound on a boom hoist drum 50, and reeved through sheaves on a lower equalizer 47 and an upper equalizer 48. The boom hoist drum is mounted in a frame 60 (FIG. 2) connected to the rotating bed. The rigging also includes fixed length pendants 21 connected between the boom top and the upper equalizer 48. The lower equalizer 47 is connected to the rotating bed 20 though the mast 28. This arrangement allows rotation of the boom hoist drum 50 to change the amount of boom hoist line 25 between the lower equalizer 47 and the upper equalizer 48, thereby changing the angle between the rotating bed 20 and the boom 22.

The boom hoist drum frame 60, the lower equalizer 47 and the upper equalizer 48 each include cooperating attachment structures whereby the lower and upper equalizers can be detachably connected to the boom hoist drum frame so that the boom hoist drum, the lower equalizer, the upper equalizer and the boom hoist line can be transported as a combined assembly. The combined boom hoist drum 50, frame 60, lower equalizer 47 and upper equalizer 48, arranged as they would be for transportation between job sites, are described in U.S. patent application Ser. No. 61/098,632.

As noted above, in a preferred embodiment, the crane includes four drums each mounted in a frame and connected to the rotating bed in a stacked configuration. (The rotating bed includes a main frame and front and rear roller carriers.) The jib hoist drum is mounted in a frame attached to the front surface of the front roller carrier. Frames of two of the four stacked drums are connected directly to the rotating bed, while the frames of the other two drums are indirectly connected to the rotating bed by being directly connected to at least one of the two drum frames connected directly to the rotating bed. In this case, the four stacked drums are preferably the first main load hoist drum 70 with load hoist line 24 wound thereon, the second main load hoist drum 80 with load hoist line 17 wound thereon, the auxiliary load hoist drum 90 with whip line 13 wound thereon, and the boom hoist drum 50 with boom hoist line 25 wound thereon. Preferably, the frame 91 of the auxiliary load hoist drum 90 and frame 81 of the second main load hoist drum 80 are connected directly to the rotating bed (the frame 91 pins at its front onto the front roller carrier), the frame 71 of the first main load hoist drum 70 is connected to both of frames 81 and 91, while the frame 60 for the boom hoist drum 50 is connected to frame 81. In that regard, the boom hoist drum frame 60 is thus stacked on top of and pinned directly to the second main load hoist drum frame 81, and the first main load hoist drum frame 71 is stacked on top of and pinned directly to the auxiliary load hoist drum frame 91. The drum frames are connected to the rotating bed and to each other by removable pins, allowing the frames to be disconnected from and transported separately from the rotating bed.

A sixth drum includes a rigging winch drum 110 on which is wound a rigging winch line 111. The rigging winch drum 110 is attached to a lower section of the rotating bed 20 and is lighter weight than the other drums. The rigging winch line 111, in one embodiment, may be a 19 mm winch line that is generally used to help assemble cranes. Herein, the rigging winch line 111 is employed to help to speed reeving the sheaves of the strut caps 31, and assembly of the main strut 29.

Figures 3, 4, 5:
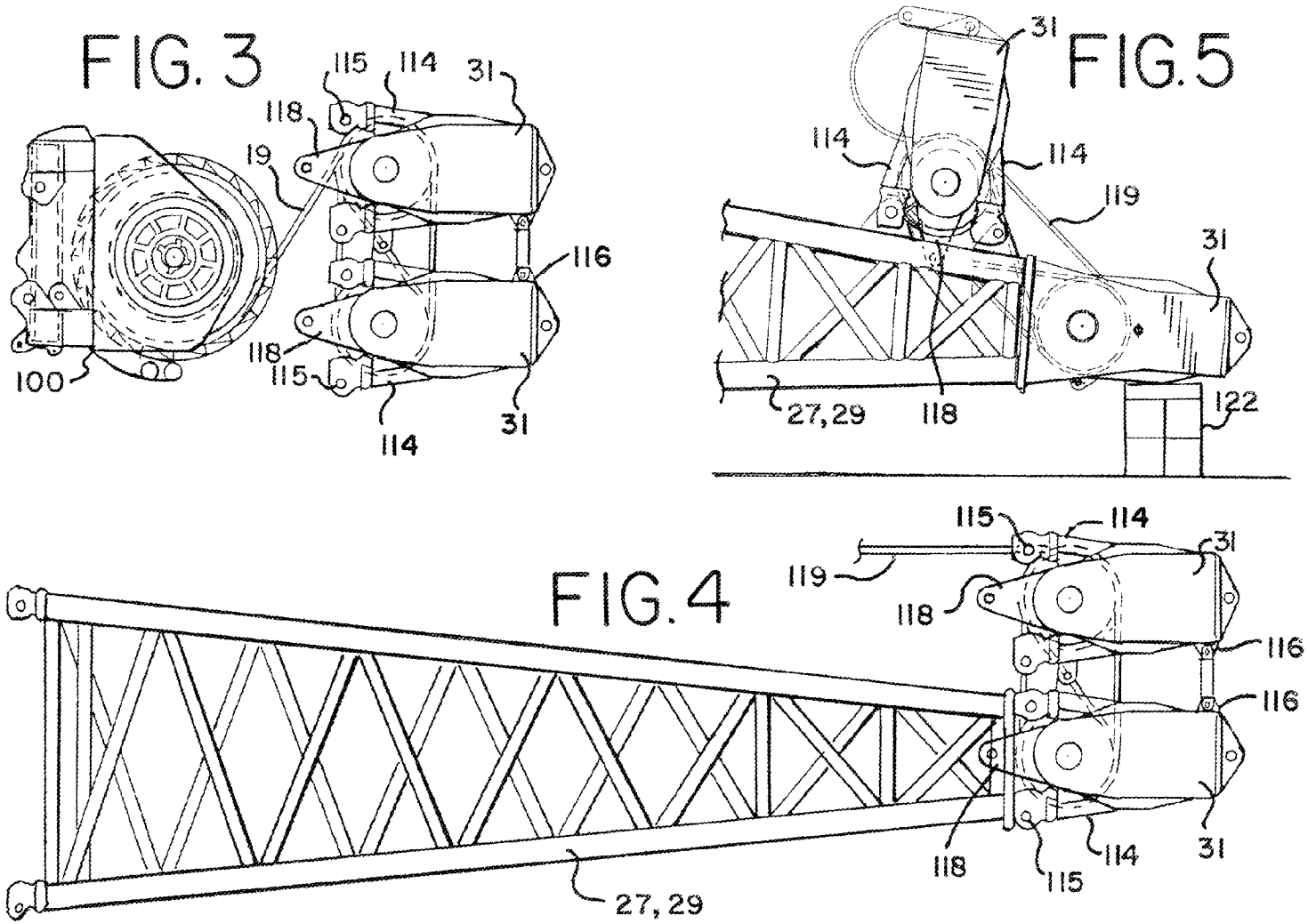
FIG. 3 is a side view of a jib hoist drum and its jib hoist line reeved with a pair of detached strut caps of the crane of FIG. 1, showing a first transport mode embodiment.
FIG. 4 is a side view of the jib strut of FIG. 1, in which the strut cap of the main strut is reeved with, and attached to, the strut cap of the jib strut, showing a second transport mode embodiment.
FIG. 5 is a side elevational view of the jib strut of FIG. 1, in which the strut cap of the main strut is attached to a side of the jib strut and reeved with the strut cap of the jib strut, showing a third transport mode embodiment.

The strut caps 31 may be transported between job sites while reeved together as a pair. Of the several different embodiments of this concept, three embodiments are shown in FIGS. 3-5. When reeved together, and possibly attached to one of the jib struts 27, 29, the struts caps 31 may be easily transported and employed for use on the jib struts 27, 29 during assembly of the crane. A first embodiment is shown in FIG. 3 in which a pair of detached strut caps 31 are reeved with the luffing jib hoist line 19 and transported with the luffing jib hoist drum 100. A second embodiment is shown in FIG. 4 in which an attached pair of strut caps 31 are reeved together and attached to one of the luffing jib struts 27, 29. A third embodiment is shown in FIG. 5 in which both strut caps 31 are attached to the end of a luffing jib strut, and remain reeved together.

More particularly, FIG. 3 displays the pair of detached strut caps 31 reeved with the luffing jib hoist line 19, wherein the luffing jib hoist line 19 has been retracted so the strut caps 31 may be transported on the same carrier as the jib hoist drum 100. In an embodiment, the strut caps 31 are transported adjacent each other so that they remain reeved together. In the embodiment of FIG. 3, the jib hoist line 19 is retracted from the wire guides 18 of the boom 22 without being threaded therethrough, to thus avoid having to un-reeve and then re-reeve the sheaves of the strut caps 27, 29 during disassembly and assembly. Any wire guides 18 attached to the boom 22 are, therefore, configured with a detachable (or hinging) section that provides for a quick release of the jib hoist line 19 directly out the detachable section thereof.

Each strut cap 31 includes, as mentioned, a number of sheaves, and also a pair of side brackets 114, each with an aperture 115 therethrough. Furthermore, each strut cap 31 includes first and second protrusions 116, 118 each having an aperture therethrough. The protrusions 116, 118 may be used for attachment of a strut cap to another strut cap, to the main or jib strut 27, 29, or to the frame of the jib hoist drum 100. These attachments may be executed by pinning. For instance, a pin is displayed in FIG. 3 for connecting the strut caps 31 to each other through the first protrusions 116. While FIG. 3 displays the strut caps 31 so attached, they need not be attached for transportation as they are still reeved together, and need only be adjacent to each other to remain reeved. Furthermore, the first or second protrusions 116, 118, or the brackets 114, may be used for attachment of the strut caps 31 to the frame of the jib hoist drum 100 for transport. Alternatively, the caps may be transported with the rigging winch drum 110, in which case the rigging winch line 111 would be reeved through the sheaves of the strut caps 31.

FIG. 4 displays an alternative embodiment of transporting the strut caps, this time with one of the strut caps 31 attached to the end of one of the main or jib struts 27, 29. As will be explained with respect to the assembly and disassembly embodiments disclosed herein, the preferred embodiment is that the strut is the jib (or first) strut 27, and the disconnected strut cap 31 displayed comes from the main (or second) strut 29. An auxiliary (or first) line 119 may be reeved through the sheaves of the strut caps 31 during disassembly of the crane so that the strut caps 31 remain reeved together during transportation. The auxiliary line 119 is a shorter piece, but long enough for reeving the sheaves of the strut caps 31, being dead-ended to one of them, or to a strut. The auxiliary line 119 may be a 19 mm line like that of the rigging winch drum 110, may be a simple piece of wire rope, or a rigging line also connected to the rigging winch drum 110.

Reeving the strut caps 31 with the auxiliary line 119 may be done by detaching a dead end of the luffing jib hoist line 19 and attaching it to the auxiliary line. Attachment of two lines to each other like this may be done with a thimble (not shown) having a hole which is attached to the end of the luffing jib hoist line 19. The 19 mm line includes wedged, two-pronged ends with holes that may be positioned over the thimble so that the two lines can then be pinned together. This arrangement is one of several methods commonly used to securely attach two lines to each other. The luffing jib hoist line 19, once attached to the auxiliary line 119, is retracted into the jib hoist drum 100 until the auxiliary line 119 is reeved within the sheaves of the strut caps. The luffing jib hoist line 19 may then be detached from the auxiliary line 119 and retracted the rest of the way into its drum 100 for transportation. The auxiliary line 119 may be dead-ended to one of the strut caps or to the strut, although it need not be, and the strut caps 31 may or may not be attached to each other. The main or jib strut 27, 29 having attached thereto the strut caps 31 reeved with the auxiliary line 119 may then be transported as an assembly.

FIG. 5 displays an alternative embodiment of that shown in FIG. 4, differing in that the strut cap attached to the main or jib strut 27, 29 is not detachable, and the detached strut cap 31 has been attached to a strut top of the strut, near the non-detachable strut cap 31 such that they may still be reeved together. In this embodiment, the protrusion 118 may be attached to the strut for added support in addition to the brackets 114. As before, the preferred embodiment is that the strut is the jib (or first) strut 27 as it is the main strut 29 that will be disassembled during disassembly of the crane. A support stand 122 may be positioned under the strut in the embodiments of either FIG. 4 or 5 during disassembly or assembly.

Figure 6:
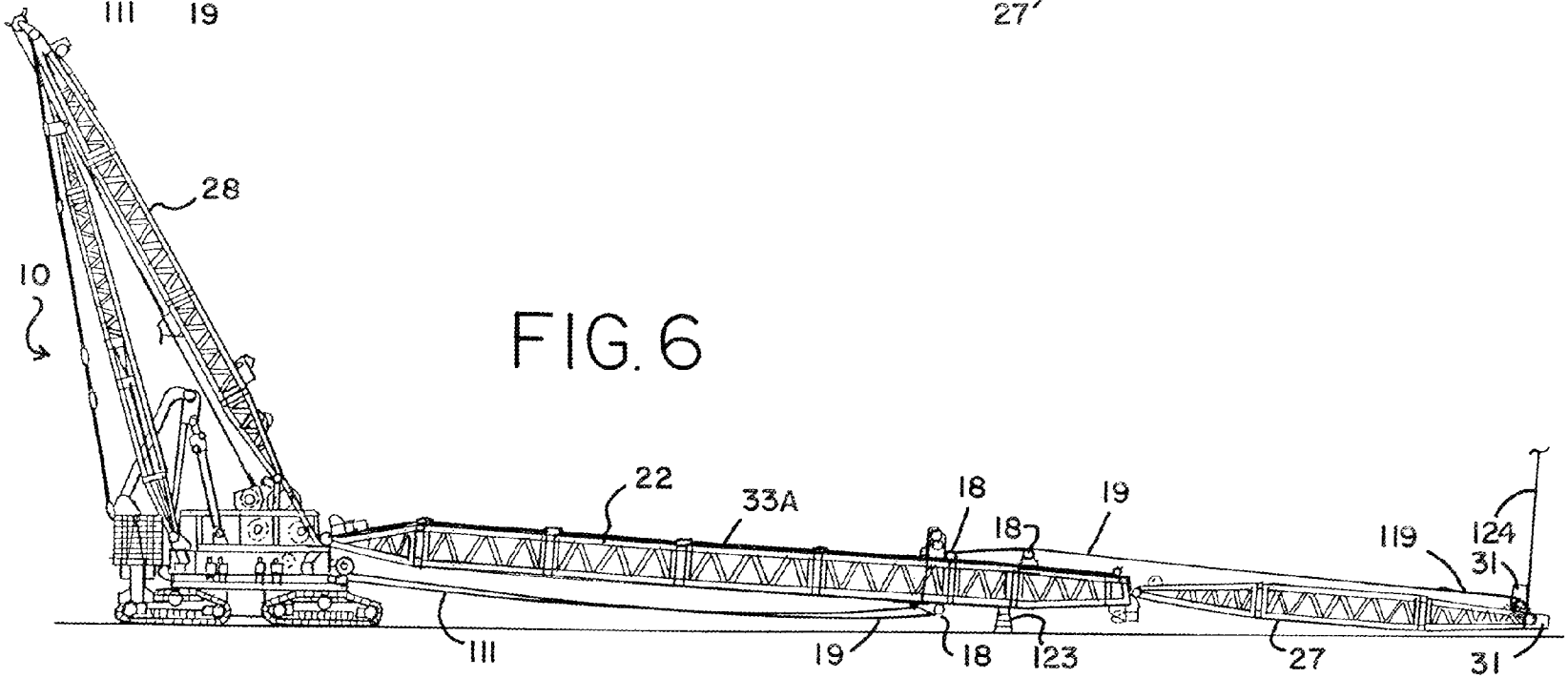

After arrival on a job site, the crane 10 may be erected to the point displayed in FIG. 6, which includes attachment of the jib strut 27 to the end of the boom 22. A support 123 may be deployed below the boom 22 to provide clearance for the rigging winch line 111 and the jib hoist line 19 below the boom. Depending on which embodiment used in FIGS. 3-5 for transportation of the strut caps 31, the assembly may differ slightly. The goal, however, is to reeve the jib hoist line 19 through the sheaves of the strut caps 31, if not already reeved. For instance, if a first embodiment shown in FIG. 3 is used for transportation, once the jib strut 27 is connected to the top of the boom, then the strut caps 31 need only be pulled away from the jib hoist drum 100, while paying out the jib hoist line 19, thus creating slack in the jib hoist line 19 so that the strut cap 31 of the jib strut 27 may be attached thereto.

In the case of the embodiments displayed in FIG. 4 or 5, the auxiliary line 119 was reeved through the strut caps 31 for transportation, and may be used to quickly reeve another line through the sheaves of strut caps. For instance, in a second embodiment (not shown), the rigging winch line 111 may be connected to one end of the auxiliary line 119 and the jib hoist line 19 to the other. The rigging winch line 111 is then retracted onto the drum 110 until the auxiliary line is removed and the jib hoist line 19 is reeved through the sheaves of the strut caps. The rigging winch line 111 can then be disconnected and retracted out of the way until it is used again in later steps discussed below. The auxiliary line 119 is also removed, but can be re-employed to reverse the steps when readying the strut caps 31 for transportation after use of the crane. In a third embodiment, the jib hoist line 19 is connected to an end of the auxiliary line 119, as before, but an assist crane line 124 may be connected to the other end of the auxiliary line 119. The assist crane lifts its line 124, thus removing the auxiliary line 119 while reeving the jib hoist line 19 therein.

Figure 7:
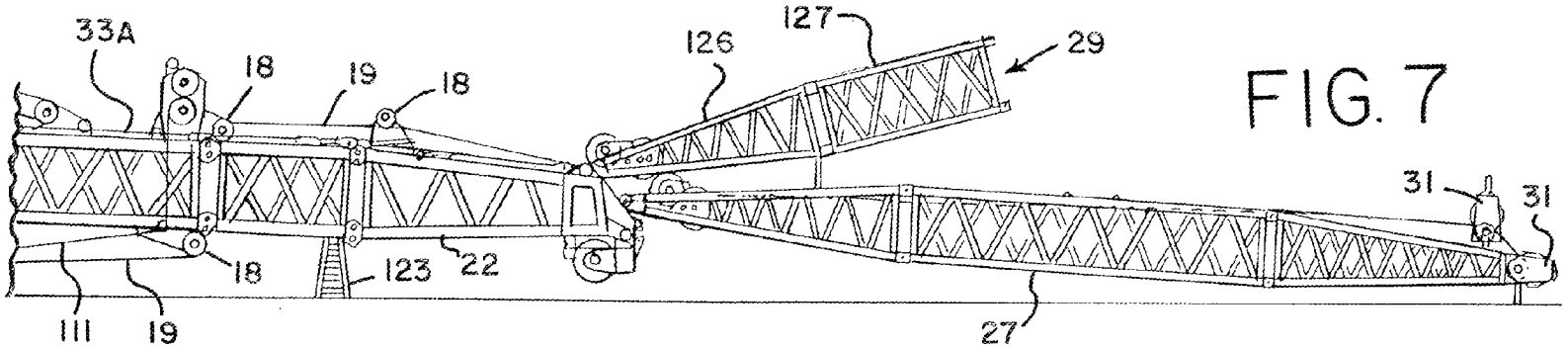
FIGS. 6 through 15 are side elevational views of the crane of FIG. 1, showing step-by-step assembly of the jib struts, wherein FIG. 6 displays the attached jib strut and quick reeving of the jib strut caps with the jib hoist line.

FIG. 7 displays the pivotal connection of a first strut section, including an assembled main strut butt 126 and first insert 127, of the main strut 29 to the top of the boom. The location of attachment to the boom 22 is not critical, but likely will be at a point somewhat distanced from the attachment point of the jib strut 27. The jib hoist line 19 may be temporarily positioned off to the side of the jib strut 27 while the main strut 29 is assembled, so that it is not in the way of that process.

Figure 8:
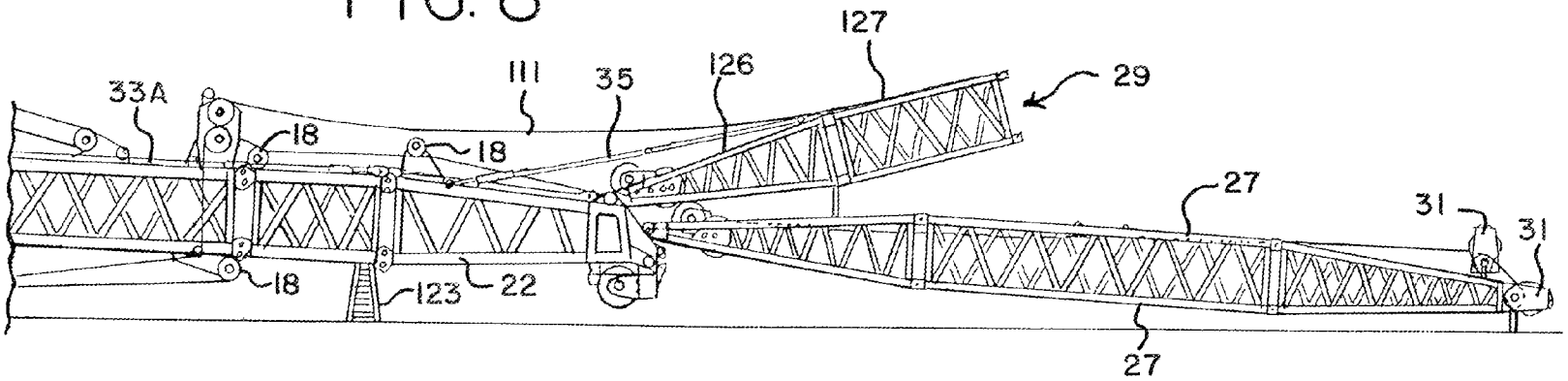
Figure 15:
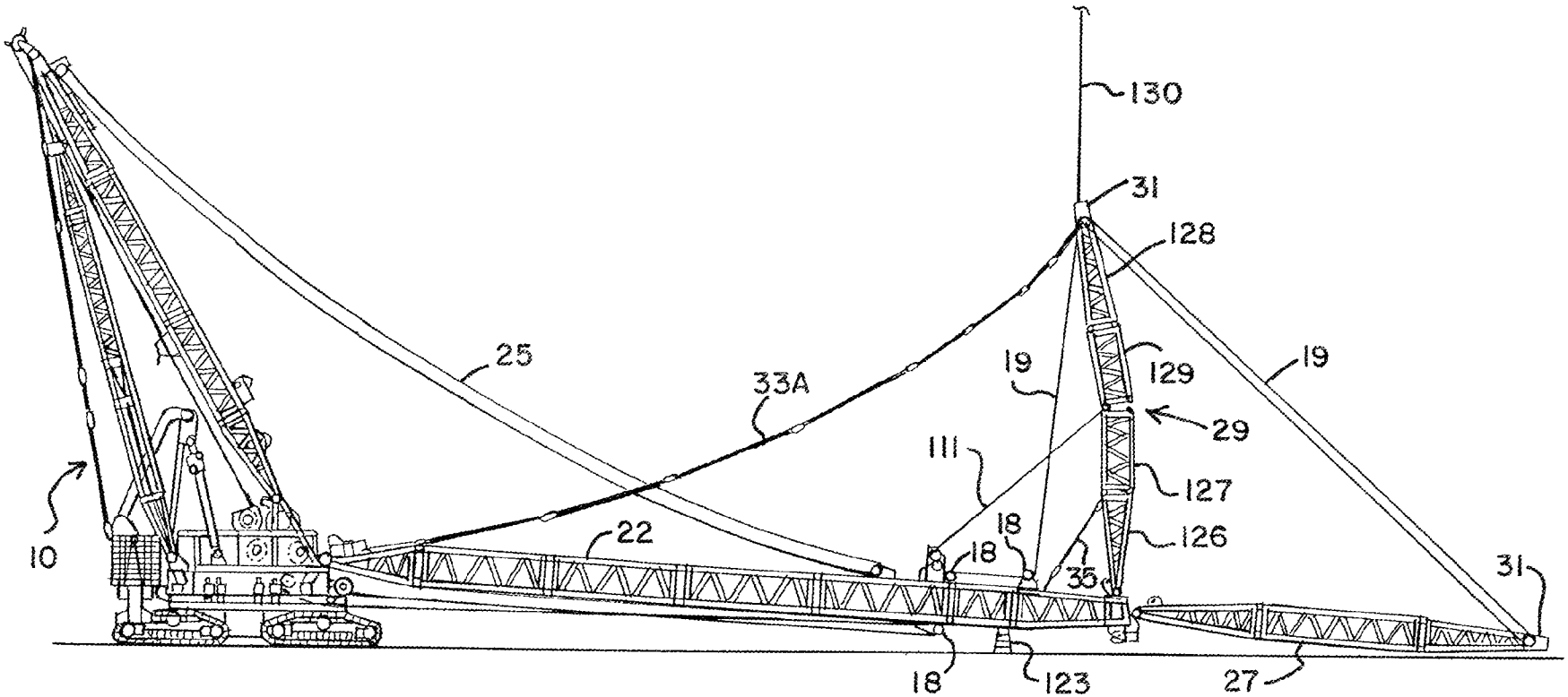

FIG. 8 displays the attachment of the strut stop 35 between the boom 22 and the main strut butt 126. The strut stop 35 is configured to extend telescopically for attachment to the top of the main strut butt 126, but to retract to a shorter position once the main strut 29 is lifted to a closed position (FIG. 15). The rigging winch line 111 is connected to the top of the first insert 127 of the main strut 29.

Figure 9:
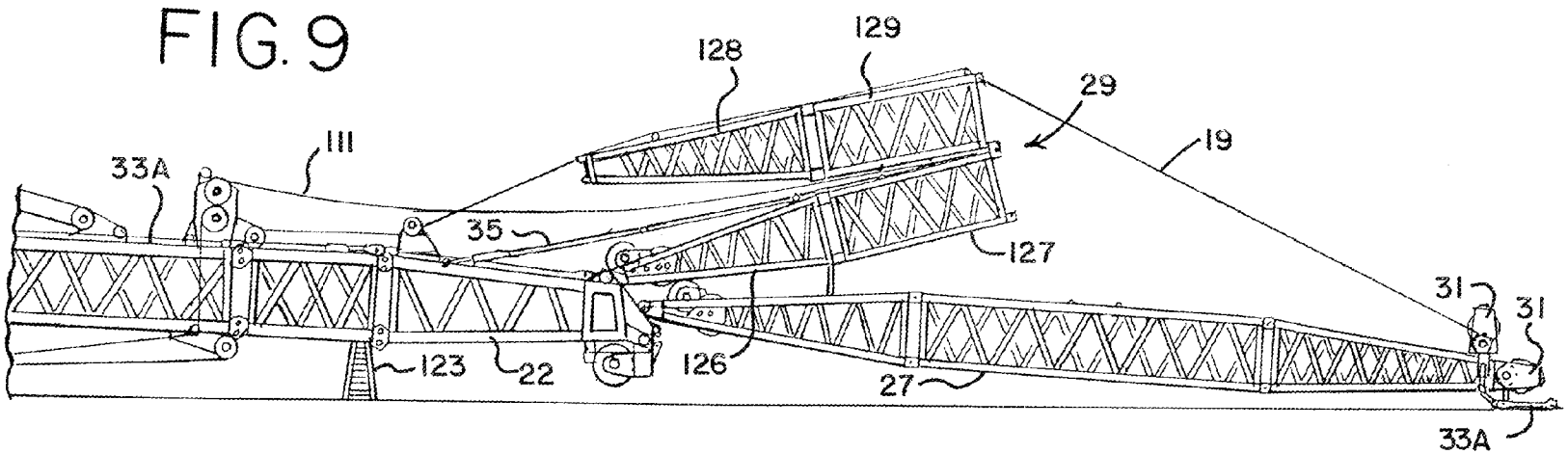

FIG. 9 displays the pivotal connection of a second strut section, including an assembled main strut top 128 and second insert 129, to the first insert 127 such that the main strut 29 is folded on itself. A number of sections of the backstay straps 33A are pinned to the main strut cap 31 depending on the height of the boom 22. The number of sections of backstay straps 33A pinned to the bottom of the boom may be keep constant, for instance, and the number of sections of backstay straps 33A pinned to the main strut cap 31 may be selected according to length required for varying boom lengths. Remember that the disclosed embodiments seek to maintain a constant angle between the main strut 29 and the boom 22, such as just under 90 degrees. Also, in FIG. 9, the jib hoist line 19 is raised over on top of the folded main strut 29 in preparation for lifting the main strut cap 31 into the air.

Figures 10, 11:
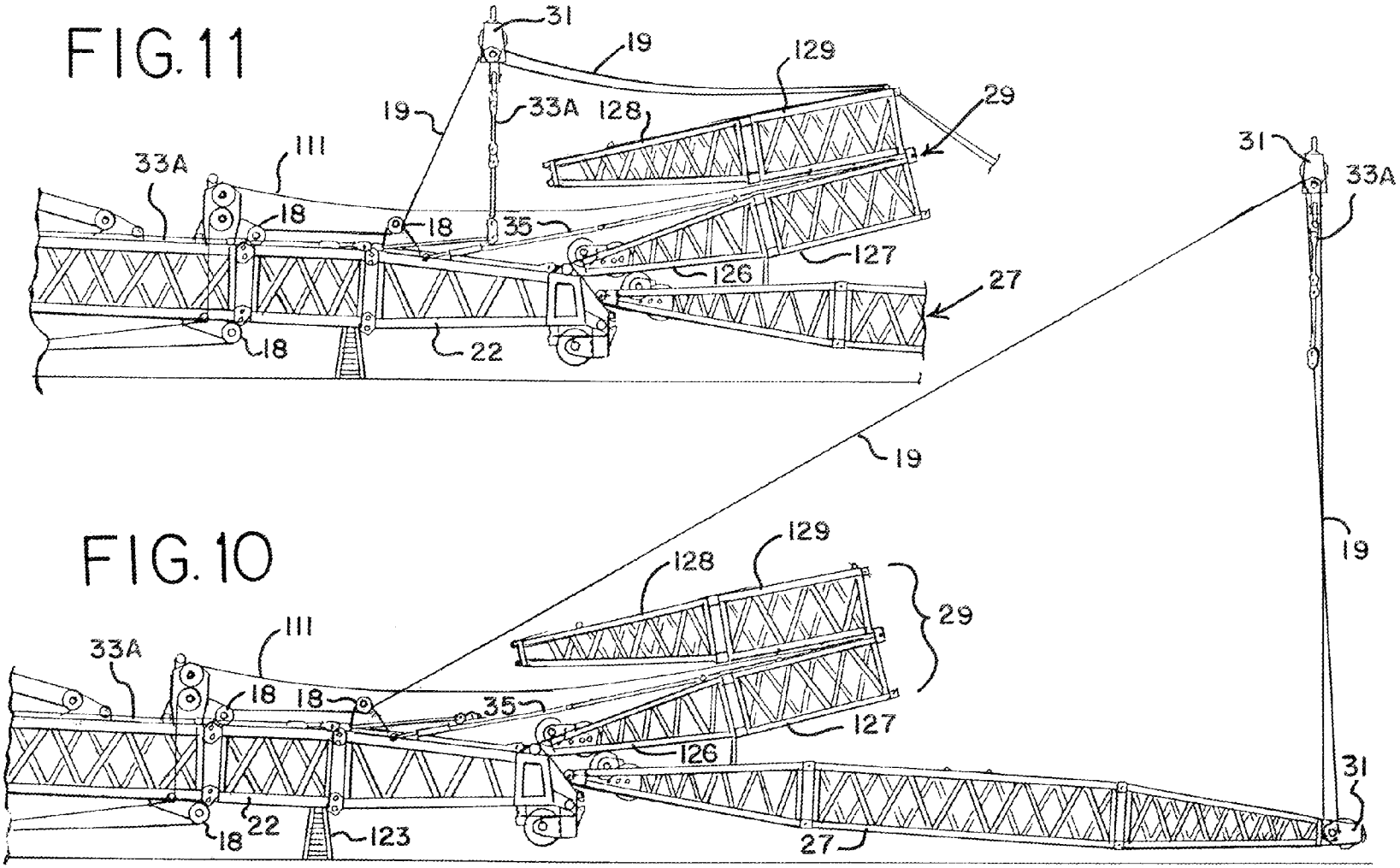

FIG. 10 displays the lifting of the main strut cap 31 and backstay straps 33A while paying out the reeved jib hoist line 19. The paying out of the jib hoist line 19 provides slack so that the main strut cap 31 (including the sections of backstay straps 33A) can be lowered to the strut top 128 of the main strut 29, as shown in FIG. 11. The sections of backstay straps 33A pinned to the main strut cap 31 are pinned to the sections of backstay straps 33A connected to the bottom of the boom 22, to complete the string of rigid backstay straps 33A between the main strut 29 and the boom 22 (FIG. 15).

Figure 12:
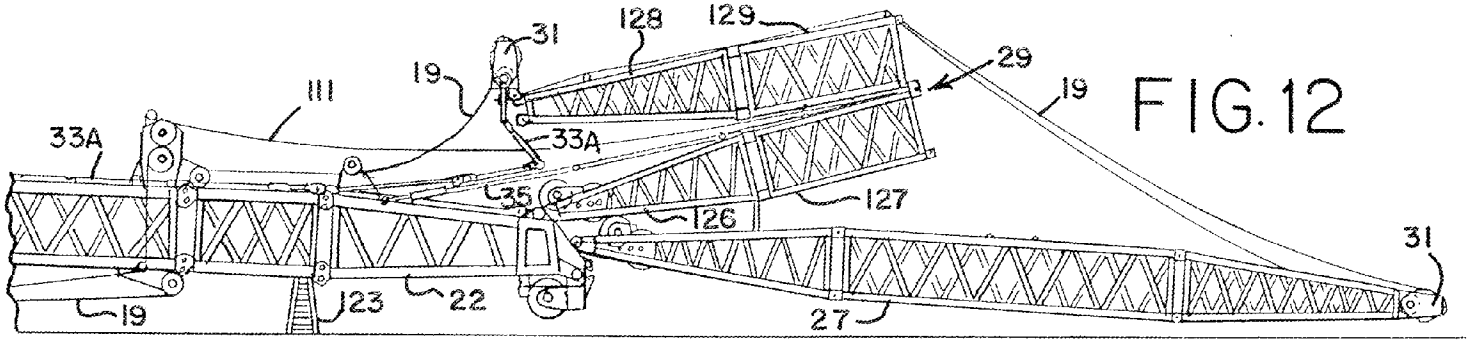
Figure 13:
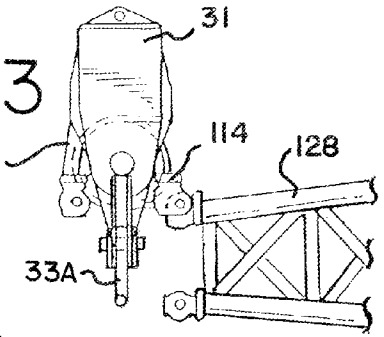
Figure 14:
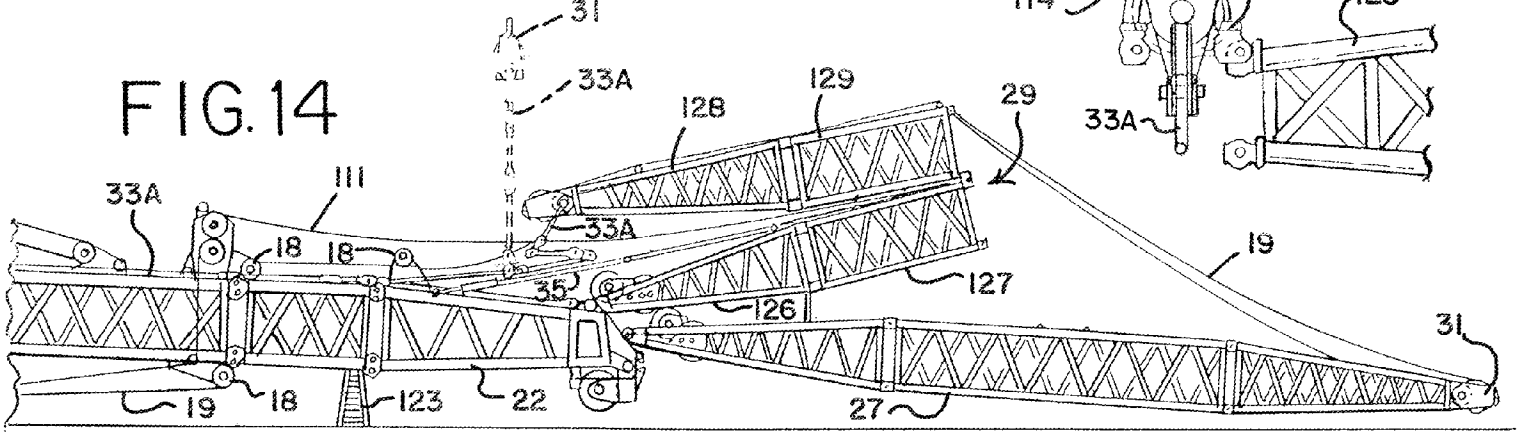

The main strut cap 31 is then attached (pinned) to the top of the main strut 29, as shown in FIGS. 12-14, using one of the brackets 114 to attach one side of the main strut cap 31, and then pivoting the strut cap to the other bracket 114 to attach the other side. While the main strut cap 31 is pivoted, the backstay straps are positioned underneath the strut top 128, on top of the strut stop 35, and if needed, the jib hoist line 19 is pulled in to take up excess slack on the reeved lines within the strut caps 31. Note that the sections of backstay straps 33A—those attached to the bottom of the boom and those attached to the main strut cap—could be pinned together, in alignment with each other, before or after the main strut cap 31 is attached to the main strut 29.

FIG. 15 displays retracting of the rigging winch line 111 while lifting the main strut top 128 and main strut cap 31. A raising pendant 130, or a rigid pole, may be pinned to the strut top 128 or main strut cap 31, and be pivotal to be attached to the main strut 29 in a storage configuration and to be lifted to connect to an assist crane (not shown) in a lifting configuration. The assist crane may lift straight up on the raising pendant 130 while the rigging winch line 111 is pulled into the rigging winch drum 110, causing the sides of the first and second inserts 127, 129 to come together as the main strut 29 straightens and closes. Accordingly, the assist crane need not travel, and assembly of the luffing jib struts is simplified The other side of the strut inserts 127, 129 may then be pinned to each other to complete assembly of the jib main strut 29. The rigging winch line 111 is disconnected, as is the assist crane from the raising pendant 130. The raising pendant is attached to the main strut 29 for storage during operation of the crane 10. The jib hoist line 19 may now be retracted to pull the jib strut 27 off the ground, generating room on the ground at the end of the boom 22 for attachment thereon of the luffing jib 23. While not displayed, sections of jib support straps 33B are pinned between the top of the luffing jib 23 and the end of the jib (or first) strut 27. Accordingly, a first number of sections of jib support straps 33B may be connected to the jib strut cap 31 before the jib strut 27 is pulled off the ground, to facilitate pinning of the first number of sections of jib support straps to the rest of the sections of jib support straps pinned to the end of the luffing jib 23.

It should be understood that various changes and modifications to the presently preferred embodiments described herein will be apparent to those skilled in the art. For instance, one or more of the strut caps may not be made removable. Furthermore, the line between the jib struts may be made rigid while one of the angles between the boom and the main and jib struts, respectively, could be made changeable with a reeved jib hoist line, thus changing slightly how the luffing jib is raised and lowered. Certain steps in the transportation of the crane and the assembly or disassembly of the struts may be performed in different orders; accordingly, any order of listing such method steps in the appended claims do not imply a required order, unless specifically required by the language of a claim. Such changes and modifications can be made without departing from the spirit and scope of the present invention and without diminishing its intended advantages. It is therefore intended that such changes and modifications be covered by the appended claims.

The invention claimed is:

1. A method of assembling a mobile lift crane, the lift crane comprising, during operation, i) a rotating bed, ii) a boom pivotally mounted on the rotating bed, iii) a luffing jib pivotally mounted to a distal end of the boom; iv) a first strut also pivotally connected to the distal end of the boom, the first strut including a first strut cap having sheaves, and v) a second strut connected to the boom below the connection point of the first strut, the second strut including a second strut cap having sheaves, the method comprising:

a) connecting the first strut, together with the first and second strut caps reeved with a first line, to the distal end of the boom;

b) connecting a second line to an end of the first line, the second line being wound around a rotatable drum mounted on an immobilized drum frame; and c) removing the first line to thereby pull the second line through the sheaves to reeve the first and second strut caps with the second line.

2. The method of claim 1, wherein the first strut cap is connected to a distal end of the first strut while being transported, wherein step b) is executed before step a), further comprising prior to assembling the mobile lift crane:

transporting to a job site the second strut cap, disconnected from a distal end of the second strut and reeved together with the first strut cap using the first line; and transporting the first and second struts to the job site.

3. The method of claim 1, wherein the lift crane, during operation, further comprises vi) a luffing jib hoist drum and line, and vii) a rigging winch drum and line, wherein each drum is attached to the rotating bed, and wherein the second line comprises the rigging winch line, the method further comprising:

connecting the luffing jib hoist line to the end of the rigging winch line;

retracting the rigging winch line to reeve the plurality of sheaves of the strut caps with the luffing jib hoist line;

disconnecting the luffing jib hoist line from the rigging winch line; and connecting a dead end of the luffing jib hoist line to one of the struts or strut caps.

4. The method of claim 1, wherein the lift crane, during operation, further comprises vi) a luffing jib hoist drum and line, and vii) a rigging winch drum and line, wherein each drum is attached to the rotating bed, and wherein the second line comprises the rigging winch line, the method further comprising:

connecting the luffing jib hoist line to the end of the rigging winch line;

retracting the rigging winch line to reeve the plurality of sheaves of the strut caps with the luffing jib hoist line;

disconnecting the luffing jib hoist line from the rigging winch line; and connecting a dead end of the luffing jib hoist line to one of the struts or strut caps.

5. The method of claim 1, wherein the lift crane, during operation, further comprises vi) a strut stop connected between the first strut and the boom, vii) a luffing jib hoist drum and line, and viii) a rigging winch drum and line, wherein each drum is attached to the rotating bed, and wherein the second line comprises the jib hoist line, the method further comprising:

d) pivotally connecting a first section of the second strut near the distal end of the boom;

e) connecting the strut stop between the boom and the first section;

f) attaching the rigging winch line to a distal end of the first section;

g) pivotally attaching a second section of the second strut to the first section such that the second section lies folded onto the first section, forming a folded second strut;

h) connecting sections of at least one jib backstay strap to the second strut cap;

i) lifting the second strut cap with an assist crane while paying out the luffing jib hoist line, to raise the second strut cap vertically and create slack between the reeved first and second caps; and j) pinning the second strut cap to a distal end of the second section 6. The method of claim 5, further comprising:

positioning the luffing jib hoist line off to a side of the first strut before step d); and laying the luffing jib hoist line over the second section of the second strut before steps i) and j).

7. The method of claim 5, further comprising:

selecting the number of the sections of the at least one jib backstay strap depending on the length of the boom.

8. The method of claim 5, further comprising:

connecting the sections of the at least one jib backstay strap to a plurality of additional sections of the at least one jib backstay strap that are attached to the mounted end of the boom;

connecting a line of the assist crane to a raising pendant attached to the end of the second section;

while raising the second section with the assist crane connected to the raising pendant, retracting the rigging winch line to bring the first and second sections into alignment with each other;

pinning off at least one connection between the first and second sections of the second strut;

disconnecting the rigging winch line and the assist crane line;

connecting a plurality of sections of at least one jib support strap between the jib strut and a distal end of the luffing jib; and connecting a proximal end of the luffing jib to the distal end of the boom.

9. A method of transporting and assembling a mobile lift crane, the lift crane comprising, during operation, i) a rotating bed, ii) a boom pivotally mounted on the rotating bed, iii) a luffing jib pivotally mounted to a distal end of the boom, iv) a first strut also pivotally connected to the distal end of the boom, the first strut including a first strut cap, v) a second strut connected to the boom below the connection point of the first strut, the second strut including a second strut cap, and vi) a luffing jib hoist drum and line, the luffing jib hoist drum attached to the rotating bed, the method comprising:

a) transporting to a job site the first and second strut caps, detached from the first and second struts, with and adjacent to the luffing jib hoist drum, wherein the luffing jib hoist line is reeved through sheaves of the first and second strut caps;

b) transporting the first and second struts to the job site;

c) connecting the first strut cap, while reeved to the second strut cap, to the end of the first strut; and d) connecting the first strut to the distal end of the boom, wherein step d) is executed before step c).

10. A method of disassembling and transporting a mobile lift crane from a job site, the lift crane comprising, during operation, i) a pair of luffing jib struts including first and second struts that are pivotally connected to the lift crane during operation; ii) a cap attached to each first and second strut, each having a plurality of sheaves, and iii) a luffing jib hoist line reeved through the plurality of sheaves of each strut cap, wherein the luffing jib hoist line dead ends on one of the struts or strut caps, the method comprising:

a) detaching at least one strut cap from a distal end of one of the luffing jib struts;

b) retracting the luffing jib hoist line until the strut caps are adjacent to each other;

c) detaching the second strut cap from a distal end of the second strut;

d) connecting the second strut cap to the first strut cap or to a strut top of the first strut;

e) connecting a first line to the dead end of the luffing jib hoist line;

f) retracting the luffing jib hoist line until free of the strut caps and the first line is reeved within the plurality of sheaves of the first and second strut caps; and g) transporting the first strut and the reeved first and second strut caps together from the job site.

11. The method of claim 10, wherein the strut caps are connected to each other while being transported from the job site.

12. The method of claim 10, wherein both of the strut caps are removed from their respective struts, the method further comprising:

h) removing the luffing jib hoist line from a plurality of wire guides attached to a boom of the crane, wherein the wire guides are designed for release of the luffing jib hoist line without being threaded therethrough;

i) retracting the luffing jib hoist line until the pair of strut caps are adjacent a luffing jib hoist drum of the lift crane;

j) attaching the connected caps to a frame of the luffing jib hoist drum; and k) transporting the pair of reeved caps together with the luffing jib hoist drum from the job site.

13. A method of assembling a mobile lift crane, the lift crane comprising, during operation, i) a rotating bed having attached thereto a luffing jib hoist drum and line, and a rigging winch drum and line, ii) a boom pivotally mounted on the rotating bed, iii) a luffing jib pivotally mounted to a distal end of the boom, iv) a first strut also pivotally connected to the distal end of the boom, v) a second strut connected to the boom below the connection point of the first strut, and vi) wherein the first and second struts have respective first and second caps attached thereto, each having a plurality of sheaves, the method comprising:

a) pivotally connecting the first strut to the distal end of the boom;

b) pivotally connecting a first section of the second strut to the distal end of the boom adjacent to the first strut;

c) reeving the luffing jib hoist line through the plurality of sheaves in each of the first and second strut caps;

d) connecting the rigging winch line to a distal end of the first section after step c) is performed;

e) pivotally attaching a second section of the second strut to the first section such that the second section lies folded onto the first section, forming a folded second strut; and f) lifting the second section while retracting the rigging winch line to thereby bring the first and second sections into alignment with each other, wherein lifting the second section comprises lifting, with an assist crane, a raising pendant attached to a strut top of the second section while retracting the rigging winch line to bring the first and second sections into alignment with each other.

14. The method of claim 13, wherein the lift crane, during operation, further comprises vi) a strut stop connected between the second strut and the boom, the method further comprising:

connecting the strut stop between the boom and the first section of the second strut stop.

15. The method of claim 14, wherein reeving the luffing jib hoist line comprises connecting a dead end of the luffing jib hoist line to one of the strut caps or one of the struts, the method further comprising:

pinning off at least one connection between the first and second sections of the second strut; and detaching the rigging winch line from the first section.

16. The method of claim 15, wherein the lift crane, during operation, further comprises vii) at least one jib backstay strap connected between the mounted end of the boom and the second cap attached to the second strut, the method further comprising:

I) connecting the reeved second cap of the second strut to a distal end of the second section; and II) before connection of the second cap to the second strut, connecting sections of the at least one jib backstay strap to the second strut cap, and connecting the sections of the at least one jib backstay strap of the second strut cap to a plurality of additional sections of the at least one jib backstay strap which are attached to the mounted end of the boom.

* * * * *

UNITED STATES PATENT AND TRADEMARK OFFICE

CERTIFICATE OF CORRECTION

PATENT NO. : 8,839,966 B2
APPLICATION NO. : 12/730421
DATED : September 23, 2014
INVENTOR(S) : Walker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 843 days.

Signed and Sealed this
Eighteenth Day of August, 2015

Michelle K. Lee

Michelle K. Lee
*Director of the United States Patent and Trademark Office*